United States Patent [19]

Moravek

[11] Patent Number: 4,773,576

[45] Date of Patent: Sep. 27, 1988

[54] CARTRIDGE HOLDER

[76] Inventor: Milton G. Moravek, 3020 W. Brentwood Blvd., Grand Island, Nebr. 68801

[21] Appl. No.: 77,498

[22] Filed: Jul. 24, 1987

[51] Int. Cl.[4] ..... A45F 5/00

[52] U.S. Cl. ..... 224/191; 224/251; 224/913; 224/150

[58] Field of Search ..... 224/101, 149, 224, 150, 224/916, 918, 251, 191, 914, 911; 89/34, 35.01; 206/443, 478

[56] References Cited

U.S. PATENT DOCUMENTS

| | | | |
|---|---|---|---|
| 162,481 | 4/1875 | Lee | 224/203 X |
| 169,936 | 11/1875 | Hare | 224/253 |
| 394,376 | 12/1888 | Kelton | 224/101 X |
| 4,299,343 | 11/1981 | Atchisson | 224/149 |
| 4,508,221 | 4/1985 | Olson | 206/443 X |
| 4,613,068 | 9/1986 | Bianchi | 224/224 X |

FOREIGN PATENT DOCUMENTS

| | | | |
|---|---|---|---|
| 300428 | 11/1928 | United Kingdom | 224/918 |

*Primary Examiner*—Henry J. Recla
*Assistant Examiner*—Robert Petrik
*Attorney, Agent, or Firm*—Zarley, McKee, Thomte, Voorhees & Sease

[57] ABSTRACT

A cartridge holder is described for mounting on either a pistol, rifle or shotgun. The cartridge holder is comprised of an elastic member which is sewn in such a manner so as to create a first loop portion which may be slipped over the forearm of a weapon to maintain the member on the weapon. A pair of spaced-apart smaller loops are also formed in the member adapted to receive a cartridge therein.

4 Claims, 1 Drawing Sheet

CARTRIDGE HOLDER

BACKGROUND OF THE INVENTION

This invention relates to a cartridge holder and more particularly to a cartridge holder which may be removably mounted on the forearm of the firearm such as a pistol, rifle, shotgun, etc.

In many instances, a hunter or shooter will be utilizing a single shot weapon. When the weapon has been fired, it is desirable to be able to quickly and conveniently load an additional cartridge into the weapon. Normally the cartridges are carried in the person's pocket, belt, etc. and the location of the same makes it inconvenient to quickly and easily re-load the weapon.

It is therefore a principal object of the invention to provide an improved cartridge holder.

It is a further object of the invention to provide an elastic cartridge holder which may be removably mounted on the forearm or front grip of a weapon in such a manner so that a pair of spare cartridges may be positioned for quick and easy access.

Yet another object of the invention is to provide a cartridge holder which will accommodate cartridges of various calibers.

Still another object of the invention is to provide a cartridge holder which does not interfere with the normal use of a weapon.

These and other objects will be apparent to those skilled in the art.

BRIEF DESCRIPTION OF THE DRAWINGS

FIG. 3 is a side view illustrating the cartridge holder mounted on a rifle or the like.

SUMMARY OF THE INVENTION

Figure 1:
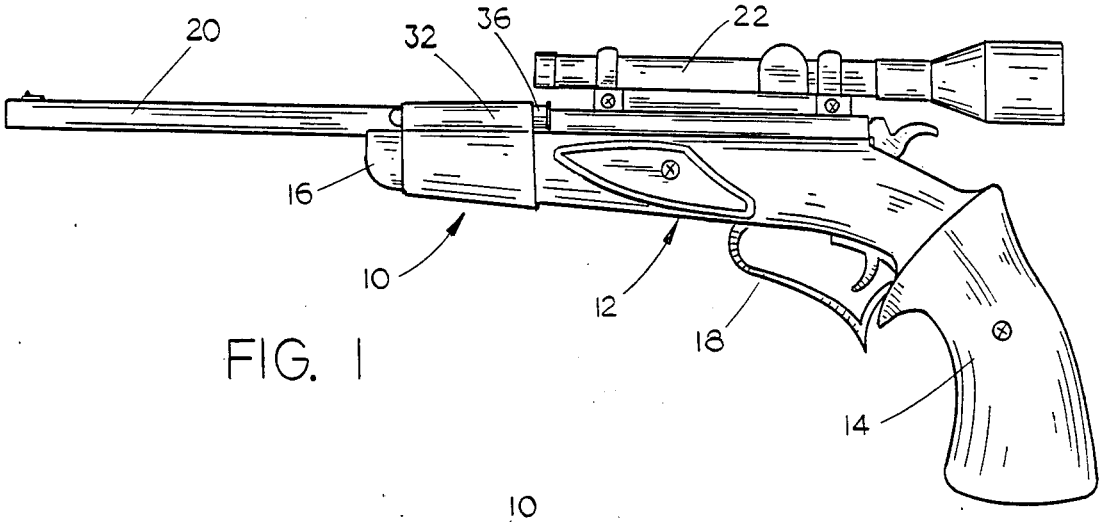
FIG. 1 is a side view of the cartridge holder of this invention mounted on a firearm.
Figure 2:
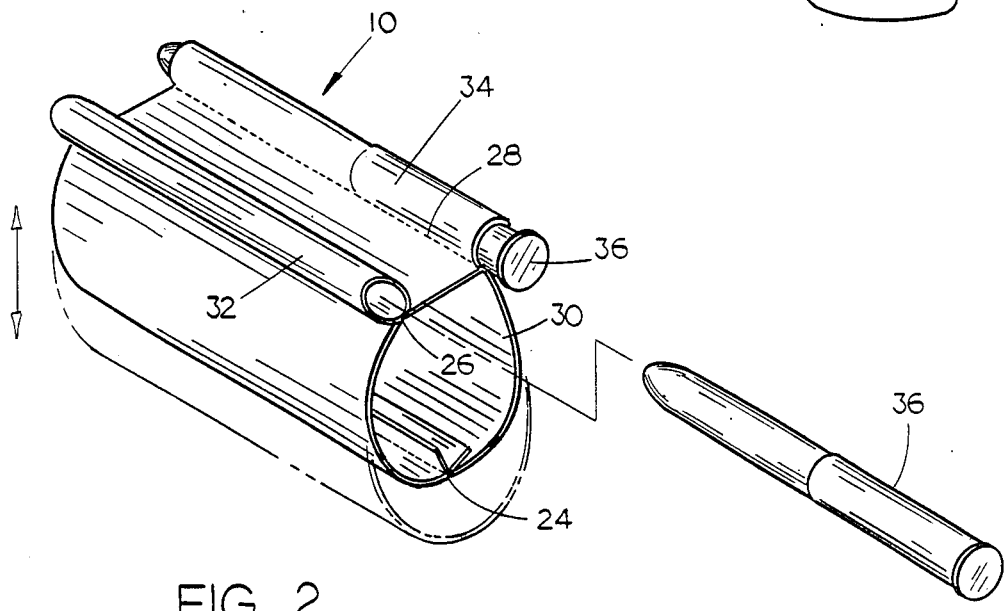
FIG. 2 is a perspective view of the cartridge holder.
Figure 3:
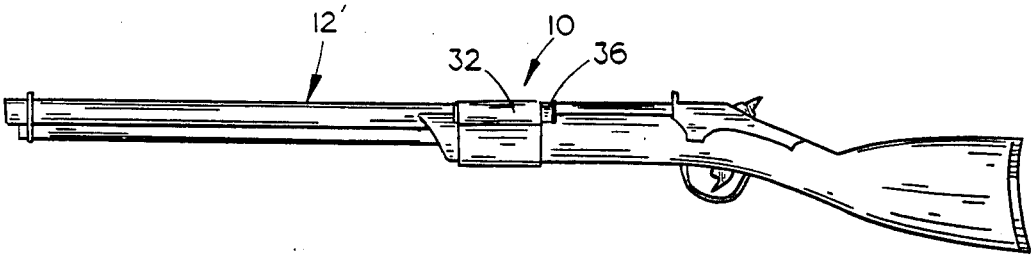

The cartridge holder of this invention is comprised of an elastic member which is sewn in such a fashion so as to create a first loop portion which may be slipped over the forearm of a weapon to maintain the member on the weapon. A pair of spaced-apart smaller loops are also created in the member which are adapted to receive a cartridge therein. When mounted on the forearm of the weapon, the holder does not interfere with the normal use of the weapon. The location of the pair of cartridges in the holder permits the reloading of the weapon.

DESCRIPTION OF THE PREFERRED EMBODIMENT

The cartridge holder of this invention is referred to generally by the reference numeral 10 while the reference numeral 12 refers to a weapon such as a pistol including a grip 14, forearm or front grip 16, trigger housing 18, barrel 20 and scope 22.

Holder 10 is constructed from an elongated rectangular piece of elastic material which is sewn along seams 24, 26 and 28 to create loop portions 30, 32 and 34. Loop portion 30 is larger than loop portions 32 and 34 and is adapted to receive the barrel and forearm of the firearm 12 as seen in the drawings. Loop portions 32 and 34 are spaced from each other and are each adapted to receive a cartridge 36 therein. The spacing and positioning of the loop portions 32 and 34 is such that the cartridges will not interfere with the normal use of the weapon.

In use, the holder 10 is positioned on the firearm as illustrated and cartridges 36 placed in the loop portions 32 and 34. When the cartridge in the breech of the firearm has been expended, the shooter may quickly and easily reload the firearm 12 by grasping one of the cartridges 36, removing the cartridge from the holder 10 and loading the same.

The elastic nature of the holder ensures that the device will be properly maintained on the firearm during periods of use. Further, the elastic configuration of the device permits the loop portions 32 and 34 to accommodate cartridges of different calibers. Further, the elastic configuration of the holder permits the loop portion 30 to accommodate various types of firearms. Although one size holder will fit many different calibers, it is contemplated that four or five different sizes of the holders will be utilized to accommodate various calibers and different types of ammunition.

Thus it can be seen that the invention accomplishes at least all of its stated objectives.

I claim:

1. In combination, a firearm including a forearm, an elastic cartridge holder removably mounted on said forearm, said cartridge holder comprising a first, cylindrical, elastic closed loop portion which expands to removably embrace the forearm to maintain said holder on the firearm, and at least a second cylindrical, elastic closed loop portion mounted on said first loop portion with its longitudinal axis generally parallel to the longitudinal axis of said first loop portion, said second loop portion having a diameter adapted to expandably, removably embrace a single cartridge therein whereby the said cartridge may be positioned therein until it is desired to load the said cartridge into the firearm.

2. The combination of claim 1 wherein said holder includes a pair of the said second loop portions mounted on said first loop portion with their longitudinal axes generally parallel to the longitudinal axis of said first loop portion, said second loop portions each having a diameter adapted to expandably, removably embrace a single cartridge so that the holder may accommodate two cartridges, said second loop portions being spaced away from each other for positioning on opposite sides of the forearm without interfering with the normal use of the firearm.

3. A cartridge holder for use on a firearm having a forearm, comprising, a cylindrical elastic first loop portion which is expandable to removably receive the forearm of the firearm whereby said member will be maintained on the firearm, and at least a second cylindrical, elastic loop portion mounted on said first loop portion with its longitudinal axis generally parallel to the longitudinal axis of said first loop portion, said second loop portion having a diameter adapted to expandably, removably embrace a single cartridge therein whereby the said cartridge may be positioned therein until it is desired to load the said cartridge into the firearm.

4. The holder of claim 3 wherein said elastic member includes a pair of the said second loop portions mounted on said first loop portion with their longitudinal axes generally parallel to the longitudinal axis of said first loop portion, said second loop portions each having a diameter adapted to expandably, removably embrace a single cartridge so that the member may accommodate two cartridges, said second loop portions being spaced away from each other for positioning on opposite sides of the forearm without interfering with the normal use of the firearm.

* * * * *